US006232029B1

(12) United States Patent
Kushino et al.

(10) Patent No.: US 6,232,029 B1
(45) Date of Patent: May 15, 2001

(54) PROCESS FOR PREPARING FLASH FIXATION TONER AND MASTER BATCH FOR USE IN SAID PROCESS

(75) Inventors: Mitsuo Kushino, Hyogo; Makoto Matsumoto, Osaka; Takashi Yodoshi, Abiko, all of (JP)

(73) Assignee: Nippon Shokubai Co., Ltd., Osaka (JP)

( * ) Notice: Subject to any disclaimer, the term of this patent is extended or adjusted under 35 U.S.C. 154(b) by 0 days.

(21) Appl. No.: 09/297,946

(22) PCT Filed: Sep. 10, 1998

(86) PCT No.: PCT/JP98/04075

§ 371 Date: Jul. 7, 1999

§ 102(e) Date: Jul. 7, 1999

(87) PCT Pub. No.: WO99/13382

PCT Pub. Date: Mar. 18, 1999

(30) Foreign Application Priority Data

Sep. 10, 1997 (JP) ..... 9-245545

(51) Int. Cl.[7] ..... G03G 9/08
(52) U.S. Cl. ..... 430/137
(58) Field of Search ..... 430/137, 126, 430/109

(56) References Cited

U.S. PATENT DOCUMENTS

| | | | | |
|---|---|---|---|---|
| 4,539,284 | | 9/1985 | Barbetta et al. | 430/110 |
| 4,824,948 | | 4/1989 | Stark et al. | 540/125 |
| 5,432,035 | | 7/1995 | Katagiri et al. | 430/106 |
| 5,582,950 | * | 12/1996 | Katagiri et al. | 430/137 |
| 5,618,648 | * | 4/1997 | Horikoshi et al. | 430/126 |

FOREIGN PATENT DOCUMENTS

| | | | |
|---|---|---|---|
| 0 412 494 A1 | 2/1991 | (EP) | G03G/9/08 |
| 60-57857 | 4/1985 | (JP) | G03G/9/08 |
| 60-63546 | 4/1985 | (JP) | G03G/9/08 |
| 63-295578 | 1/1988 | (JP) | C07D/487/22 |
| 3-72371 | 3/1991 | (JP) | G03B/9/087 |
| 6-043690 | 2/1994 | (JP) . | |
| 6-118694 | 4/1994 | (JP) . | |
| 6-301232 | 10/1994 | (JP) | G03G/9/08 |
| 6-348056 | 12/1994 | (JP) . | |
| 7-333890 | 12/1995 | (JP) . | |
| 9-080817 | 3/1997 | (JP) . | |
| 9-179347 | 7/1997 | (JP) . | |

* cited by examiner

*Primary Examiner*—John Goodrow
(74) *Attorney, Agent, or Firm*—Fish & Richardson P.C.

(57) ABSTRACT

A method for the production of a flash fixing toner containing at least a binding resin, a coloring agent, and an infrared absorbent, which method is characterized by the steps of blending a master batch containing said infrared absorbent at a concentration 3–50 times as thick as that intended to be incorporated ultimately in the toner, with other toner components, thereby forming a toner composition containing said infrared absorbent at a requested concentration, melting and kneading said toner composition, cooling the molten toner composition, and then pulverizing the solidified toner composition.

3 Claims, No Drawings

PROCESS FOR PREPARING FLASH FIXATION TONER AND MASTER BATCH FOR USE IN SAID PROCESS

BACKGROUND OF THE INVENTION

1. Technical Field

This invention relates to a method for the production of a flash fixing toner and a master batch for use in the method of production. More particularly, this invention relates to the technique for producing a flash fixing toner containing an infrared absorbent.

2. Background Art

For the operation of fixing an image on a material for printing in the electrophotography, the heat roll system has been mainly used heretofore. Since this system contemplates forming an image with a toner on a material for printing such as paper and passing the material carrying the image of toner thereon between opposed heating rolls thereby causing the toner to be deposited fast on the material by thermo-compression bonding, however, it is prone to such problems as exposing a fixing part thereof to the possibility of being clogged, suffering the formed image to be crushed and consequently degrading the resolution thereof, and imposing a limit on the kind of material for printing.

The flash fixing system constitutes itself one version of the non-contact fixing system and proves an excellent fixing system free from the problems encountered by the heat roll system as described above. Since this system requires to fix the toner by the fact that the component in the toner absorbs the light of a xenon flash lamp, particularly the infrared ray, however, it permits only defective fixation of a color toner which profusely uses a coloring material possessing no or only feeble ability to absorb the infrared ray.

As a means for solving the problem of this defective fixation, JP-A-63-161,460 has proposed an idea of causing an infrared absorbent having a light absorption peak at a wavelength in the range of 800–1100 nm to be incorporated by dispersion in the flash fixing toner.

The manufacture of a toner is generally carried out by a continuous procedure which comprises premixing a toner composition comprising a binding resin, a coloring agent, and an electric charge controlling agent in a powder mixing device such as a Henschel mixer, then continuously feeding the resultant mixture to a kneading device such as a biaxial extruding device, melting and kneading the mixture therein thereby inducing dispersion of the additives such as the coloring agent in the binding resin, and pulverizing and classifying the formed blend. The degree with which such additives as the coloring resin are dispersed in the binding resin by the dispersing work and the uniformity of the concentration of the produced dispersion are important factors which affect the solid state properties of the toner.

In the flash fixing toner formed by incorporating therein the aforementioned infrared absorbent, since the degree of dispersion and the inconsistency of uniformity of the infrared absorbent in the toner are factors directly bearing on the fixing of the toner, the degree of dispersion and the uniformity of concentration to be expected of this toner will be very high.

Since the infrared absorbent is incorporated in the toner composition in a small amount as compared with the binding resin, the coloring agent, etc., it is very difficult to render constant the concentration of the infrared absorbent in the toner composition which is continuously melted, kneaded, and extruded during the manufacture of the toner even when the premixing work is carried out thoroughly during the production of the toner.

Further, since the productivity of the toner constitutes itself a very important point, the melting and kneading time to be spent as in the biaxial extruding device during the course of the kneading mentioned above is limited and no longer deserves to be called sufficient for fine dispersion of the infrared absorbent.

The defective dispersion and the ununiform concentration of the infrared absorbent not merely cause inferior fixing of the toner as described above. The infrared absorbent, when suffered to disperse in a localized state, tends to absorb the flash light and emit excess heat and possibly compels the toner part to form voids (white spots in image). In addition to the problem of the ability to absorb the infrared ray, the problem of the charging property to be exhibited to the toner inevitably arises from the structure, the functional group, etc. of the compound of the infrared absorbent.

DISCLOSURE OF INVENTION

With respect to the flash fixing toner depicted above, the desirability of developing a technique for attaining uniform and fine dispersion of an infrared absorbent in a toner composition comprising a binding resin, a coloring agent, a charge controlling agent, etc. has been finding growing approval.

This invention, therefore, has for an object thereof the provision of an improved method for the production of a flash fixing toner. This invention has a further object of providing a method for the production of a flash fixing toner which permits an infrared absorbent to be uniformly and finely dispersed in a toner composition comprising a binding resin, a coloring agent, and a charge controlling agent. This invention has another object of providing a method of production which permits production of a flash fixing toner having a high capacity for absorption of infrared ray, exhibiting a highly satisfactory flash fixing property, and providing economically advantageous.

The present inventors, after performing diligent studies successively with a view to attaining the objects mentioned, have discovered that when a toner is produced by preparing a master batch containing an infrared absorbent intended for incorporation in a flash fixing toner at a concentration 3–50 times the final concentration of the infrared absorbent in the flash fixing toner, compounding this master batch with toner components such as a binding resin and a coloring agent by a prescribed formula, then premixing them, and continuously feeding the resultant mixture to a biaxial extruding device, the toner to be produced is allowed to have the infrared absorbent finely dispersed therein and have the concentration or distribution of the infrared absorbent kept uniform between the adjoining toner particles and within the individual toner particles. The present invention has been perfected as a result.

This invention which accomplishes the various objects mentioned above concerns a method for the production of a flash fixing toner containing at least a binding resin, a coloring agent, and an infrared absorbent, which method is characterized by blending a master batch, which contains an infrared absorbent intended for incorporation in the toner at a concentration 3–50 times as thick as the final concentration of the infrared absorbent in the toner, with other toner components, thereby forming a toner composition containing the infrared absorbent at a requested concentration, melting and kneading the toner composition, cooling the molten toner composition, and then pulverizing the solidified toner composition.

This invention further discloses a method for the production of a flash fixing toner mentioned above, wherein the infrared absorbent is an infrared absorbent having a maximum absorption wavelength in the range of 750 nm–1100 nm.

This invention further discloses a method for the production of a flash fixing toner mentioned above, wherein the infrared absorbent is incorporated at a ratio in the range of 0.01 wt. %–5 wt. % of the total amount of the toner composition.

The objects mentioned above are further accomplished by a master batch of infrared absorbent for use in a flash fixing toner, characterized by having the infrared absorbent which is dissolved in a resin component being to be incorporated in the toner and which has a concentration in the range of 0.5–15 wt. % of the total amount of the master batch.

The objects mentioned above are further accomplished by a master batch of infrared absorbent for use in a flash fixing toner, characterized by having the infrared absorbent which is dispersed in the form of particles, not more than 0.5 $\mu$m in particle diameter, in a resin component being to be incorporated in the toner and which has a concentration in the range of 0.5–35 wt. % of the total amount of the master batch.

BEST MODE FOR CARRYING OUT THE INVENTION

Now, this invention will be described more specifically below by reference to preferred embodiments of the invention.

Infrared absorbent

The infrared absorbent which can be used in the present invention imposes no particular restriction but requires only to be capable of absorbing the infrared ray. From the viewpoint of efficiently absorbing the light issuing from a xenon flash lamp which is a typical light source in the flash fixing and emitting heat consequently, the infrared absorbent requires to have a maximum absorption wavelength preferably in the range of 750–1100 nm, more preferably in the range of 800–1100 nm.

As concrete examples of the infrared absorbent, cyanine compounds, diimonium compounds, aminium compounds, Ni complex compounds, phthalocyanine compounds, anthraquinone compounds, and naphthalocyanine compounds may be cited.

As commercially available versions of such infrared absorbents, Kayasorb IR-750, IRG-002, IRG-003, IRG-022, IRG-023, IR-820, CY-2, CY-4, CY-9, CY-10, CY-17, and CY-20 made by Nippon Kayaku Co., Ltd. and bis(1,2-diphenylecene-1,2-dioctyl) nickel may be cited.

Further, the infrared absorbent is preferred to be capable of being dissolved or finely dispersed in the resin component destined to form a matrix in the manufacture of a master batch as described specifically herein below because this capability can be expected to improve the uniformity of distribution of the concentration or dispersion of the infrared absorbent between the toner particles and within the individual toner particles in the finally produced flash fixing toner. When the infrared absorbent is dissolved in the binding resin of the toner, the infrared absorbent is enabled to manifest thoroughly the inherent ability thereof and, even if incorporated only in a minute amount, still enabled to fuse efficiently the binding agent by the action of heat generation during the course of flash fixing because the infrared absorbent incorporated in the binding resin is dispersed therein on a molecular level.

The infrared absorbent which can be dissolved or finely dispersed in the resin component as described above is not easily set forth generally because the solubility thereof is dominated by the kind of the resin component to be used in the master batch. As concrete examples of the infrared absorbent, however, those of the various kinds of compounds of the group enumerated above which have incorporated such functional groups as shown below for the purpose of acquiring improved solubility may be cited.

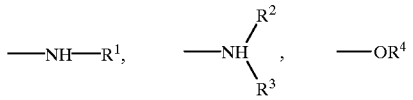

(wherein $R^1$–$R^4$ independently stand for an alkyl group of C1–C20, a phenyl group, a tolyl group, a xylyl group, a naphthyl group, an ethylphenyl group, a propylphenyl group, a butylphenyl group, or a naphthyl group).

of the commercially available infrared absorbents cited above, those which exhibit highly satisfactory solubility or fine dispersibility to the resin component include Kayasorb IRG-002, IRG-003, and CY-10, for example.

Among other infrared absorbents which are usable for the present invention, those which are represented by the following general formula (I) may be cited as particularly preferable examples.

The infrared absorbents formed of such phthalocyanine type compounds as represented by the general formula (I) manifest highly satisfactory compatibility with such resins which are usable as the binding resin for the flash fixing toner and can be distributed in a dissolved state or a finely dispersed state in the resin.

(I)

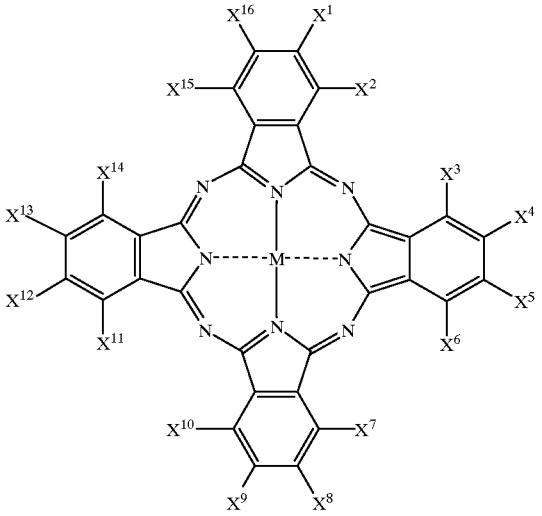

(wherein at least one of the substituents, $X^1$–$X^{16}$, is NH-R (providing that R stands for an alkyl group of 1–8 carbon atoms or, a nonsubstituted or optionally substituted aryl group, preferably a nonsubstituted or optionally substituted phenyl group) and M stands for a nonmetal, a metal, a metal oxide, a metal carbonyl, or a metal halogenide).

The metals represented by M in the compounds of the general formula (I) include copper, zinc, cobalt, nickel, iron, vanadium, titanium, indium, aluminum, tin, gallium, and germanium, for example and the metal halogenides represented by M include fluorides, chlorides, and bromides, for example. The central atoms or atomic groups of M are preferred to be possessed of copper, zinc, cobalt, nickel, iron, vanadyl, titanyl, chloroindium, tin chloride, gallium chloride, dichlorogermanium, indium iodide, aluminum iodide, gallium iodide, cobalt carbonyl, or iron carbonyl. Particularly, those which are possessed of vanadyl or tin chloride prove especially preferable.

In the general formula (I), the substituents, $X^1$–$X^{16}$, in the aromatic ring of the phthalocyanine skeleton are preferred to include at least one, preferably not less than three, and more preferably four–ten, NH-R groups.

As concrete examples of the NH-R substituent, alkyl amino groups such as methyl amino, ethyl amino, p-propyl amino, isopropyl amino, n-butyl amino, isobutyl amino, tert-butylamino, n-pentylamino, and n-octylamino; and aryl amino or substituted aryl amino groups such as anilino, o-toluidino, p-toluidino, m-toluidino, 2,4-xylidino, 2,6-xylidino, 2,4-ethyl anilino, 2,6-ethyl anilino, o-methoxy anilino, p-methoxy anilino, m-methoxy anilino, o-ethoxy anilino, p-ethoxy anilino, m-ethoxy anilino, 2,4-ethoxy anilino, 2,6-ethoxy anilino, o-fluoro anilino, p-fluoro anilino, tetrafluoro anilino, and p-ethoxycarbonyl anilino may be cited.

The other substituents that are allowed to occur as the substituents, $X^1$–$X^{16}$, in the general formula (I), hydrogen atom, halogen atoms, and the groups represented by the following general formulas (1)

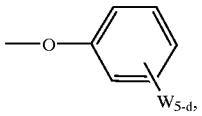

(2)

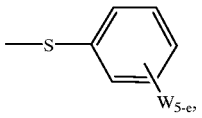

(3)

$$—OR^1,$$

(4)

$$—SR^2$$

(wherein $R^1$ and $R^2$ independently stand for an alkyl group of 1–8 carbon,atoms, W stands for hydrogen atom, an alkyl group of 1–4 carbon atoms, an alkoxyl group of 1–4 carbon atoms, or a halogen, and d and e independently stand for an integer of 1–5) are included.

The term "alkyl group of 1–4 carbon atoms" as used herein means amethyl group, an ethyl group, an n-propyl group, an isopropyl group, an n-butyl group, an isobutyl group, and a tert-butyl group. The term "alkyl group of 1–8 carbon atoms" means a linear or branched pentyl group, a linear or branched hexyl group, a linear or branched heptyl group, and a linear or branched octyl group in addition to the alkyl groups mentioned above. The term "alkoxyl group of 1–4 carbon atoms" means a methoxyl group, an ethoxyl group, an n-propoxyl group, an n-butoxyl group, an isobutoxyl group, and a tert-butoxyl group. The term "acyl group of 1–4 carbon atoms" means a formyl group, an acetyl group, a propionyl group, a butyryl group, and an isobutyryl group.

The halogen atoms as other substituents include fluorine atom, chlorine atom, bromine atom, and iodine atom. Among other halogen atoms, fluorine atom and chlorine atom prove preferable and fluorine atom proves particularly preferable. The possession of a fluorine atom as a substituent can be expected to improve the solubility of the infrared absorbent.

As concrete examples of the other substituent represented by the general formula (1), phenoxy, o-methyl-phenoxy, o-methoxy-phenoxy, o-fluoro-phenoxy, tetrafluorophenoxy, p-methyl-phenoxy, andp-fluoro-phenoxy may be cited.

As concrete examples of the other substituent represented by the general formula (2), phenylthio, o-methyl-phenylthio, o-methoxy-phenylthio, o-fluoro-phenylthio, tetrafluorophenylthio, and p-methyl-phenylthio may be cited.

As concrete examples of the other substituent represented by the general formula (3), methoxy, ethoxy, p-propyloxy, isopropoxy, n-butoxy, isobutoxy, tert-butoxy, n-pentyloxy, and n-octyloxy may be cited.

As concrete examples of the other substituent represented by the general formula (4), methylthio, ethylthio, p-propylthio, isopropylthio, n-butylthio, isobutylthio, tert-butylthio, n-pentylthio, andn-octylthio may be cited.

In the phthalocyanine type compound represented by the 9 general formula (I), it suffices that at least one, preferably not less than three, and particularly preferably four to ten, of the 16 substituents, $X^1$–$X^{16}$, are those represented by NH-R as mentioned above. Further, it is favorable that the central atom or central atomic group represented by M in the general formula (I) is vanadyl or tin chloride. It is further favorable that the positions other than the positions of the substituents represented by NH-R are invariably occupied by fluorine atoms or substituents represented by the general formulas (1), (2), (3), or (4) mentioned above. While the possession of the substituents represented by NH-R and further the possession of VO or $SnCl_2$ as the central metal atom M are advantageous because they can be expected to improve the solubility of the phthalocyanine type compound in the binding resin and allow shift of the maximum absorption peak to the greater wavelength side in the range of wavelength of 750–1100 nm, the inclusion of fluorine atoms or substituents represented by the general formula (1), (2), (3), or (4) mentioned above in the substituents other than those mentioned above is particularly advantageous because it can be expected to improve the solubility further or allow further shift of the maximum absorption peak to the greater wavelength side. Of course, the remainder substituents mentioned above (except the hydrogen atom) can also contribute to improve the solubility of the compound in the binding resin and/or allow the maximum absorption peak to be shifted as requested toward the greater wavelength side in the range of wavelength of 750–1100 nm, although the degree of contribution for such effects would be varied with the kind of substituents.

Among the phthalocyanine type compounds that are represented by the general formula (I), those which are represented by the following general formula (II) or (III) prove more advantageous. Among the compounds of these general formulas (II) and (III), those represented by the general formula (III) prove especially advantageous.

(II)

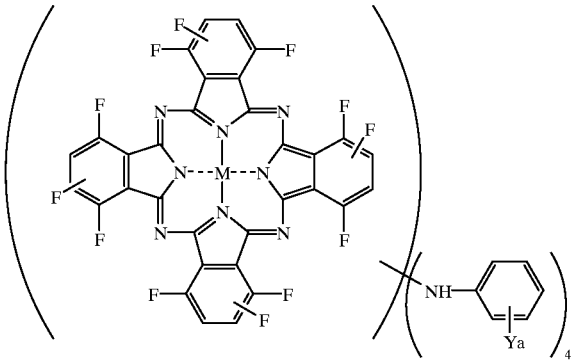

M = $SnCl_2$ (wherein Y stands for an alkyl or alkoxyl group of 1–4 carbon atoms and a for 1 or 2.)

(III)

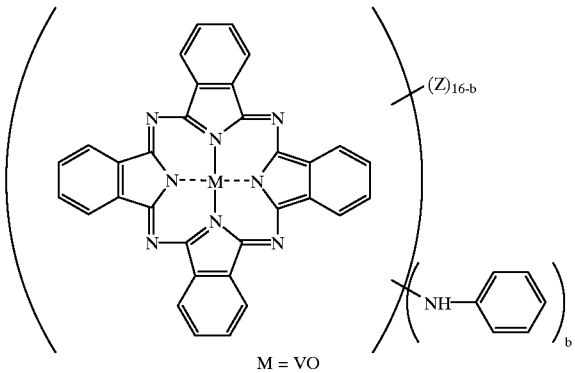

M = VO (wherein Z stands for a nonsubstituted or optionally substituted phenylthio group, a nonsubstituted or optionally substituted phenoxy group, an alkoxyl group of 1–8 carbon atoms, an alkylthio group of 1–8 carbon atoms, or a fluorine atom, particularly preferably a fluorine atom, and b for an integer of 6–10.).

As preferred, though only a little, concrete examples of the phthalocyanine type compound represented by the general formula (I), octakis(anilino)-octafluorovanadyl phthalocyanine, octakis-(anilino)-octakis(phenylthio) vanadyl phthalocyanine, 4-tetrakis-(anilino)-3,5,6-dodecafluorotin chloride phthalocyanine,4-tetra-kis(o-ethoxyanilino)-3,5,6-dodecafluoro tin chloride phthalocyanine, 4-tetrakis(2,6-ethylanilino)-3,5,6-dodecafluoro tin chloride phthalocyanine, and 4-tetrakis(2,4-dimethoxyanilino)-3,5,6-dodecafluoro tin chloride phthalocyanine may be cited, but not limited to. In the designations of these compounds, the 4 and 5 positions of the substitution of the matrix structure indicate the substituents, $X^1$, $X^4$, $X^5$, $X^8$, $X^9$, $X^{12}$, $X^{13}$, and $X^{16}$ and the 3 and 6 positions thereof indicate the substituents, $X^2$, $X^6$, $X^7$, $X^{10}$ , $X^{11}$, and $X^{15}$.

Since she flash fixing, unlike the heat roll fixing, effects the fixation of the toner by absorbing the light emitted from a xenon flash lamp and generating heat consequently, the site of fixation instantaneously reaches a temperature in the approximate range of 300° C.–600° C. If the temperature of the infrared absorbent to start yielding to thermal decomposition or the temperature thereof to withstand thermal degradation is unduly low, the gas arising from the decomposition will possibly compel the fixed image to sustain voids (white spots in image). The temperature of the infrared absorbent to be used in the present invention, therefore, is required to have a temperature for withstanding thermal degradation of not less than 230° C., preferably not less than 250° C., and most desirably not less than 300° C.

Master batch of infrared absorbent

In the method for the production of the flash fixing toner according to the present invention, the infrared absorbent of the quality described above is used in the form of a master batch when it is incorporated as one component in the toner composition.

The master batch under discussion uses as a matrix thereof the resin component to be incorporated in the flash fixing toner and has the infrared absorbent of the aforementioned quality incorporated as uniformly dispersed or dissolved in the matrix.

The concentration of the infrared absorbent in the master batch of this nature, though variable to a certain extent with the specific mode of embodiment because the solubility or dispersibility thereof varies with the kind of infrared absorbent and the kind of resin component to be used and the combination of these two components, is generally required to fall in the range of 0.5–35 wt. %, preferably 1–20 wt. %, of the total amount of the master batch. If the concentration of the infrared absorbent in the master batch is less than 0.5 wt. %, the time of treatment required for the infrared absorbent to be uniformly distributed at such a low concentration in the resin matrix will be inevitably elongated. Conversely, if the concentration exceeds 35 wt. %, the concentration of the infrared absorbent will be too high for the infrared absorbent to be efficiently dissolved or finely dispersed in the entire volume thereof in the matrix.

When the master batch is in such a mode that the infrared Iabsorbent may exist in a dissolved state in the resin matrix, the infrared absorbent is required to account for a ratio in the range of 0.5–15 wt. %, preferably 1–10 wt. %, to the total amount of the master batch on account of the restriction which is imposed by the solubility on the resin component of the infrared absorbent.

In contrast, when the master batch of the infrared absorbent according to this invention is in such a mode that the infrared absorbent may exist in a dispersed state in the resin matrix, the infrared absorbent contained in the master batch at the aforementioned concentration in the range of 0.5–35 wt. %, preferably 1–20 wt. %, is required to be finely dispersed in the form of particles having diameters of not more than 0.5 $\mu$m, preferably not more than 0.3 $\mu$m, and more desirably not more than 0.1 $\mu$m.

The infrared absorbent, depending on the kind thereof, can be perfectly dissolved in the resin component of the toner composition at a use concentration in the toner composition during the final manufacture of the flash fixing toner such as, for example, a concentration in the approximate range of 0.01–5 wt. %. If the concentration reaches a level higher than the upper limit of the range mentioned above or exceeds the saturated concentration at the end of the manufacture of the master batch, however, the possibility may arise that the undissolved part of the infrared absorbent will persist in a granular form in the resin matrix. The master batch of the infrared absorbent of the present invention, even when compelled by the relation between the amount of incorporation and the degree of solubility to assume a state having part of the infrared absorbent dissolved in the resin matrix and the rest thereof dispersed in the form of undissolved particles, can be used without any particular problem and can be embraced in the dispersed type mentioned above.

Again in this case, it is proper that the infrared absorbent is contained in the master batch at a concentration in the range of 0.5–35 wt. %, preferably 1–20 wt. %, based on the total amount of the master batch and that the dispersed particles or the undissolved particles of the infrared absorbent having diameters of not more than 0.5 μm, preferably not more than 0.3 μm, and more desirably not more than 0.1 μm are finely dispersed.

The concentration of the infrared absorbent in the master batch is required from the viewpoint of the manufacture of the flash fixing toner to be 3–50 times, preferably 3–30 times, the concentration of the infrared absorbent added to the toner composition. If the concentration of the infrared absorbent in the master batch is less than three times that of the infrared absorbent to be incorporated, the shortage will bring such disadvantages as causing an undue addition to the amount of the master batch, suffering the production of the master batch and consequently the manufacture of the toner to consume much time, and boosting the cost of the toner. If the concentration is more than 50 times that of the infrared absorbent to be incorporated, the excess will cause an undue addition to the concentration of the infrared absorbent and possibly disable thorough elimination of the inferior dispersion of the infrared absorbent in the produced toner and the lack of uniformity of the concentration.

The resin component which is fated to form the matrix of the master batch of the infrared absorbent according to the present invention imposes no particular restriction but requires only to be infallibly incorporated in the flash fixing toner aimed at in an amount at least larger than the amount of the infrared absorbent to be incorporated. The most typical and favorable resin component is a resin which functions as the binding resin which constitutes itself a main component of the toner. As other examples of the proper resin component, the wax incorporated in the toner, the resin used for the adjustment of the electric charge, and the resin incorporated for the purpose of improving the special quality of the binding resin may be cited. Further, the resin which, though incapable of improving the special quality of the binding resin, has compatibility with or ready dispersibility in the binding resin can be used as the matrix of the master batch the resin, so long as the resin brings no serious degradation of the special quality.

As concrete examples of the resin which can be used as the matrix of the master batch of the infrared absorbent, the resins of the polystyrene type, the resins based on the copolymers of styrene with (meth)acrylates, acrylonitrile, or maleic esters, the resins of the poly(meth)acrylic ester type, the resins of the polyester type, polyamide type, epoxy type, phenol type, hydrocarbon type, and rosin, modified rosin, terpene resin, and pinene resin may be cited, though not exclusively. These resins can be used either singly or in the form of a combination of two or more members. Among these resins, the resin that is identical with the resin to be incorporated in the toner composition as the binding resin of the flash fixing toner to be ultimately produced proves particularly favorable. Specifically, the polyester resin or the epoxy resin of bisphenol A/epichlorohydrin which constitutes itself a proper binding resin for the flash fixing toner as will be specifically described herein below proves favorable.

Various methods can be adopted for the production of the master batch containing the kind of infrared absorbent mentioned above. Several of these methods are cited by way of examples. The production contemplated by this invention does not need to be limited to the methods cited below but may be effected by any method which does not depart from the spirit of this invention.

A method which comprises melting and kneading the infrared absorbent and the resin component with a melting and kneading device such as, for example, a biaxial extruding device, a three-roll kneader, or a Banbury mixer, a method which comprises dissolving the infrared absorbent in advance in a solvent, adding the resultant solution to the resin component, and melting and kneading the produced mixture with the melting and kneading device mentioned above while removing the solvent, and a method which comprises finely dispersing the infrared absorbent in advance in a solvent by the use of a wet dispersing device such as, for example, a sand mill, colloid mill, or ball mill and the adding the product of the fine dispersion to the resin component and melting and kneading the resultant mixture with the melting and kneading device mentioned above while removing the solvent may be cited. Incidentally, during the work of melting and kneading with the melting and kneading device mentioned above, the viscosity of the resin component properly falls in the range of $10^3$ P–$10^5$ P (poises), preferably in the range of $3\times10^3$ P–$4\times10^4$ P.

The master batch can be manufactured by a method of polymerization instead of the aforementioned methods which resort to the work of melting and kneading. Specifically, this method consists in causing a polymerizing monomer capable of forming a required resin component by polymerization to be polymerized in the presence of the infrared absorbent. The production of the master batch by this method of polymerization can be carried out by varying forms of polymerization such as, for example, solution polymerization, bulk polymerization, suspension polymerization, emulsion polymerization, and dispersion polymerization so long as the infrared absorbent is dissolved or finely dispersed and allowed to assume a uniformly distributed state in the resin component to be obtained by the polymerization. Among other forms of polymerization cited above, particularly the suspension polymerization, the emulsion polymerization, and the dispersion polymerization prove commendable.

The polymerizing monomers that can be used in the suspension polymerization, emulsion polymerization, and dispersion polymerization are not particularly limited. As concrete examples of the polymerizing monomer, styrene type monomers such as styrene, o-methyl styrene, m-methyl styrene, p-methyl styrene, α-methyl styrene, p-methoxy styrene, p-tert-butyl styrene, p-phenyl styrene, o-chlorostyrene, m-chlorostyrene, and p-chlorostyrene; (meth)acrylic ester type monomers such as methyl acrylate, ethyl acrylate, n-butyl acrylate, isobutyl acrylate, dodecyl acrylate, stearyl acrylate, 2-ethylhexyl acrylate, tetrahydrofurfuryl acrylate, methyl methacrylate, ethyl methacrylate, propyl methacrylate, n-butyl methacrylate, isobutyl methacrylate, n-octyl methacrylate, dodecyl methacrylate, 2-ethylhexyl methacrylate, and stearyl methacrylate; olefin type monomers such as ethylene, propylene, and butylene; and various vinyl type polymers such as acrylic acid, methacrylic acid, vinyl chloride, acrylonitrile, acryl amide, methacryl amide, and N-vinyl pyrrolidone may be cited. These polymerizing monomers may be used either singly or in the form of a combination of two or more members.

As concrete examples of the dispersant or emulsifier to be used in the suspension polymerization, dispersion polymerization, and emulsion polymerization, macromolecular dispersants such as polyvinyl alcohol, gelatin, tragacanth, starch, methyl cellulose, carboxy methyl cellulose, hydroxyethyl cellulose, sodium polyacrylate, sodium polymethacrylate, and polyvinyl pyrrolidone; surfactants such as sodium dodecylbenzene sulfonate, sodium tetradecyl sulfate, sodium pentadecyl sulfate, sodium octyl sulfate, sodium allyl-alkyl-polyether sulfonate, sodium oleate, sodium laurate, sodium caprylate, sodium caproate, sodium stearate, potassium oleate, sodium 3,3'-disulfodiphenyl urea-4,4'-diazo-bis-amino-8-naphthol-6-sulfonate, ortho-carboxy-benzene-azo-dimethyl aniline, sodium 2,2',5,5'-tetramethyl-triphenyl methane-1,1'-diazo-bis-β-naphthol-disulfonate, sodium alkylnaphthalene sulfonate, sodium dialkylsulfosuccinate, sodium alkyldiphenyl ether disulfonate, sodium polyoxyethylene alkyl sulfate, polyoxyethylene alkylether sulfuric acid triethanol amine, ammonium polyoxyethylene alkylphenyl ether sulfate, sodium alkylsulfonate, sodium salts of β-naphthalene sulfonic acid-formalin condensate, sodium salts of special aromatic sulfonic acid-formaline condensate, special carboxylic acid type macromolecular surfactants, polyoxyethylene lauryl ether, polyoxyethylene cetyl ether, polyoxyethylene stearyl ether, polyoxyethylene octylphenyl ether, polyoxyethylene nonylphenyl ether, polyoxyethylene sorbitan alkylate, lauryl trimethyl ammonium chloride, stearyl trimethyl ammonium chloride, cetyl trimethyl ammonium chloride, distearyl dimethyl ammonium chloride, and alkylbenzyl dimethyl ammonium; and alginates, zein, casein, barium sulfate, calcium sulfate, barium carbonate, magnesium carbonate, calcium phosphate, talc, clay, diatomaceous earth, bentonite, titanium hydroxide, sodium hydroxide, and metal oxide powders may be cited.

The initiators of the oil-soluble peroxide type or the azo type can be generally adopted as polymerization initiators for use in the suspension polymerization and the dispersion polymerization. As typical examples of the initiators, peroxide type initiators such as benzoyl peroxide, lauroyl peroxide, octanoyl peroxide, benzoyl orthochloroperoxide, benzoyl orthomethoxyperoxide, methylethyl ketone peroxide, diisopropyl peroxy dicarbonate, cumene hyrdoperoxide, cyclohexane peroxide, t-butyl hydroperoxide, and diisopropyl benzene hydroperoxide; and 2,2'-azobisisobutyronitrile, 2,2'-azobis(2,4-dimethyl valeronitrile), 2,2'-azobis(2,3-dimethylbutyronitrile), 2,2'-azobis (2-methylbutyronitrile), 2,2'-azobis (2,3,3-trimethylbutyronitrile), 2,2'-azobis (2-isopropylbutyronitrile), 1,1'-azobis (cyclohexane-1-carbonitrile), 2,2'-azobis(4-methoxy-2,4-dimethylvaleronitrile), 1- (carbamoylazo) isobutyronitrile, 4,4'-azobis(4-cyanovaleric acid), and dimethyl-2,2'-azobisisobutyrate may be cited. As concrete examples of the water-soluble initiator for use in the emulsion polymerization, persulfates such as sodium persulfate, potassium persulfate, and ammonium persulfate, organic peroxides such as tertiary isobutyl hydroperoxide, cumene hydroperoxide, and paramethane hydroperoxide, and hydrogen peroxide may be cited. These polymerizing monomers are properly used at a ratio in the range of 0.01–20 wt. %, particularly 0.1–10 wt. %, to the polymerizing monomer.

The time and the method of incorporation of the infrared absorbent in the polymerizing monomer composition during the production of the master batch by the method of polymerization described above are not particularly limited. The method for dispersion or dissolution of the infrared absorbent in the polymerizing monomer is not particularly restricted. These methods are properly selected so that the infrared absorbent may be present uniformly in the produced polymer and the state of this presence may be in a dissolved state or finely dispersed state.

Specifically, the incorporation can be effected at any of the steps of manufacturing the polymerizing monomer composition in a polymerization system, dispersing the polymerizing monomer composition in a dispersion medium, subjecting the polymerizing monomer composition to a polymerization reaction, and optionally subjecting the product of the polymerization to a coagulating treatment.

For the purpose of dissolving the infrared absorbent in the polymerizing monomer composition, the simplest method of dissolving the infrared absorbent in a polymerizing monomer or the method of dissolving the infrared absorbent by melting and kneading it in a resin which is soluble in a polymerizing monomer are available. By melting and kneading the infrared absorbent in advance in a resin soluble in a polymerizing monomer and then adding the resin now containing the infrared absorbent to the polymerizing monomer and dissolving it therein, even the infrared absorbent which inherently exhibits no or only meager solubility to the polymerizing monomer can be dissolved in the polymerizing monomer owing to the fact that the resin manifests the function of a surfactant.

As means for dispersing the infrared absorbent, various methods are available. As a typical example of the means, a method which comprises adding the infrared absorbent in a finely dispersed state to such polymerizing monomer, solvent, aqueous medium, and resin as are used in the polymerizing system or the system for coagulating treatment may be cited. In the components mentioned above, the resin does not mean a polymer which is obtained in consequence of the polymerization of a polymerizing monomer composition but means a resin which can be incorporated in the polymerizing monomer composition of this quality and can be dissolved in this polymerizing monomer composition or a resin which can be added to and dissolved in a solvent to be used in the polymerization system.

As typical examples of the method for fine dispersion of the infrared absorbent in such liquid components as polymerizing monomer and solvent, a method resorting to such a high-speed shearing type dispersing device as homomixer, biomixer, or Ebara milder, a method resorting to such an attrition type dispersing device as colloid mill or homomix line mill, and a method resorting to such a media mill as ball mill, side grind mill, pearl mill, or attriter may be cited.

As a means for dispersion as in the resin, a method which comprises melting and kneading the infrared absorbent with the resinby the use of arollmill, kneader, pressure kneader, Banbury mixer, Labo plast mill, or uniaxial or biaxial kneading and extruding device thereby finely dispersing the infrared absorbent in solid components such as the resin may be cited.

Though the degree with which the treatment for fine dispersion of the infrared absorbent is carried out is governed by the kinds of polymerizing monomer, solvent, aqueous medium, resin, etc. in which the infrared absorbent is incorporated and treated for dispersion, it is properly set such that the infrared absorbent, when dispersed, may form particles having diameters not preceding 0.5 $\mu$m, preferably falling in the approximate range of 0.01–0.3 $\mu$m.

The master batch of the infrared absorbent according to this invention is formed by adopting as a matrix thereof the resin component incorporated in the toner and causing the infrared absorbent of the quality mentioned above to be dissolved or finely dispersed in the matrix as described above. This master batch is allowed to incorporate in advance therein other additives such as, for example, a wax component and an electric charge controlling agent which are incorporated in minute amounts similarly to the infrared absorbent in the flash fixing toner to be eventually manufactured.

The form of the master batch is not particularly limited. The master batch may assume arbitrarily any of such forms as lumps, powder, scales, and pellets. Among other forms cited above, powder and pellets prove particularly favorable.

Binding resin

Now, the components other than the infrared absorbent which are used in the method for the production of the flash fixing toner of this invention will be cited below by way of example.

The binding resin does not need to impose any particular restriction. As concrete examples of the binding resin, the resins of the polystyrene type, the type of copolymers of styrene with (meth)acrylic esters, acrylonitrile, or maleic esters, the poly(meth)acrylic ester type, thepolyester type, the polyamide type, the epoxy type, the phenol type, the hydrocarbon type, and the petroleum type may be cited. Polyester resins or epoxy resins such as bisphenol A/epichlorohydrin are preferable examples. These resins may be used either singly or in the form of a mixture of two or more members and may be used in combination with other resins and additives.

Coloring agent

The coloring agent to be used may be selected arbitrarily from varying coloring agent known heretofore. As concrete examples of the coloring agent, pigments or dyes including black coloring agents such as carbon black, furnace black, and acetylene black, yellow coloring agents such as chrome yellow, cadmium yellow, yellow iron oxide, titanium yellow, chrome yellow, naphthol yellow, hanza yellow, pigment yellow, benzidine yellow, permanent yellow, quinoline yellow, and anthrapyrimidine yellow, orange coloring agents such as permanent orange, molybdenum orange, Valcan fast orange, benzine orange, and indanthrene brilliant orange, brown coloring agents such as iron oxide, amber, and permanent brown, red coloring agents such as iron oxide red, rose iron oxide red, antimony powder, permanent red, fire red, brilliant carmine, lightfast red toner, permanent carmine, pyrazolone red, Bordeaux, helio Bordeaux, rhodamin lake, DuPont oil red, thioindigo red, thioindigomaroon, and watching red strontium, purple coloring agents such as cobalt purple, fast violet, dioxane violet, and methyl violet lake, blue coloring agents such as methylene blue, aniline blue, cobalt blue, ceryl amblue, chalco oil blue, nonmetallic phthalocyanine blue, phthalocyanine blue, ultra marine blue, indanthrene blue, and indigo, and green coloring agents such as chrome green, cobalt green, pigment green B, green gold, phthalocyanine green, malachite green oxalate, and polychromebrome copper phthalo-cyanine may be cited. These pigments or dyes may be used either singly or in the form of a mixture of two or more members.

Since the flash fixing toner of this invention is aimed at improving the flash fixing property by the addition of the infrared absorbent, it manifests a particularly large effect in the case of a color tone using a coloring agent other than black.

These coloring agents are properly incorporated in a given toner composition in an amount in the range of 3–15 parts by weight, based on 100 parts by weight of the binding resin, though this amount is not critical for this invention.

Other additives

The flash fixing toner of this invention, when necessary, is allowed to incorporate therein other additives such as wax component, electric charge controlling agent, and fluidifying agent.

Polyolefin type waxes and natural waxes are usable as the wax component. As concrete examples of the polyolefin type wax, polyethylene, polypropylene, polybutylene, ethylene-propylene copolymer, ethylene-butene copolymer, ethylene-penthene copolymer, ethylene-3-methyl-1-butene copolymer, and copolymers of olef ins with other monomers such as, for example, vinyl esters, haloolefins, (meth)acrylic esters, (meth)acrylic acid or derivatives thereof may be cited. These polyolefin type waxes are preferred to have weight average molecular weights in the approximate range of 1000–45000. As concrete examples of the natural wax, carnauba wax, montan wax, and natural paraffin may be cited.

As concrete examples of the electric charge controlling agent, nigrosin, monoazo dye, zinc, hexadecyl succinate, alkyl esters or alkyl amides of naphthoeic acid, nitrohumic acid, N,N-tetramethyl diamine benzophenone, N,N-tetramethyl benzidine, triazine, and metal complexes of salicylic acid may be cited. When the flash fixing toner of this invention is in the form of a color toner using a coloring agent other than black, the electric charge controlling agent to be used is preferred to have no color or a light color.

The fluidifying agents which are usable herein include inorganic minute particles of colloidal silica, hydrophobic silica, hydrophobic titania, hydrophobic zirconia, and talc and organic minute particles such as polystyrene beads and (meth)-acrylic resin beads, for example.

Method for production of flash fixing toner

The method for the production of the flash fixing toner according to this invention is characterized by using the master batch of infrared absorbent of the kind mentioned above when the infrared absorbent is to be incorporated in the toner composition by a specific formulation. To be specific, the toner aimed at is produced by preparing amaster batch containing the infrared absorbent at a concentration 3–50 times that of the infrared absorbent to be ultimately incorporated in the toner, compounding the master batch with such binding resin and coloring agent as mentioned above optionally in conjunction with other additives which have been weighed out in prescribed amounts thereby forming a toner composition containing the infrared absorbent at a requested concentration, melting and kneading the produced toner composition, cooling the molten toner composition, then pulverizing the cooled toner composition, and optionally further classifying the pulverized toner composition. Since the master batch has the resin component as the matrix thereof, the amounts of the components in the toner composition ought to be adjusted in due respect of the function which is expected to be fulfilled by the resin component when it is incorporated in the toner. When the resin component functions as a binding resin, for example, it is only natural that the total amount of the binding resin in the toner composition is the sum of the amount of the resin component in this master batch and the amount of the resin separately incorporated as a binding resin.

In the method of production according to this invention, the device to be used in melting and kneading the toner composition as described above imposes no restriction particularly but requires only to be capable of producing a flash fixing toner such that the infrared absorbent may exist in the ultimately formed binding resin as dissolved or finely dispersed in the form of particles having a diameter of not more than 0.5 $\mu$m, preferably not more than 0.3 $\mu$m, and more preferably not more than 0.1 $\mu$m and that the concentration distribution of the infrared absorbent may be uniform between adjoining toner particles and within individual toner particles. As concrete examples of the device effectively usable herein, a roll mill, a kneader, a pressure kneader, a Banbury mixer, a Labo plast mill, and a uniaxial or biaxial kneading and extruding device may be cited. It is permissible to adopt a step of premixing the toner composition by the use of a Henschel mixer, a super mixer, a V blender, or a tumble blender, as occasion demands, prior to the operation of melting and kneading mentioned above. The toner composition during the course of melting and kneading assumes a viscosity in the range of $10^3$ P–$10^5$ P (poises), preferably in the range of $3\times10^3$ P–$4\times10^4$ P.

Since the method of production of this invention uses the master batch as the source of the infrared absorbent as described above, it accomplishes uniform concentration distribution or dispersion distribution of the infrared absorbent in the toner composition even by a kneading treatment performed for a relatively short duration or a kneading treatment performed in a continuous production.

Shape and use of flash fixing toner

The flash fixing toner to be produced by the method of production according to this invention has a volume average particle diameter in the approximate range of 3–15 μm, preferably 5–15 μm, and more preferably 5–10 μm, though variable with the degree of resolution aimed at in the process of electrophotography.

If the volume average particle diameter of the toner exceeds 15 μm, the toner will have too large a particle diameter to permit production of an image of fully satisfactory resolution. Conversely, if this diameter is less than 3 μm, the shortage will impair the stability of the produced image because of low flowability of the toner particles and will cause fogging and poor cleaning despite the fact that the image has high resolution.

A xenon flash lamp is used for fixing the flash finishing electrophotographic toner according to this invention. For the purpose of this fixation, the xenon flash lamp is preferred to be operated with an electric input energy per unit area in the range of 1.6–3 J/cm$^2$. The toner is used safely so long as the degree of fixation thereof is not less than 70%. If this degree is less than 70%, however, the fixed toner will be excoriated by frictional force and suffered to smear other objects which happen to touch it.

The flash fixing toner of this invention can be used advantageously for various applications such as, for example, bar code printers, label printers, tag printers, and printers and copying devices of the Carlson system or the ion flow system. Particularly in the mode of embodiment in colored prints, since the flash fixing toner allows inexpensive aprovision of products which manifest an ideal flash fixing property, it readily satisfies the demand for coloration of images in such applications as mentioned above.

EXAMPLES

Now, this invention will be described more specifically below by reference to working examples thereof. It should be noted, however, that this invention is not limited to these working examples. Wherever "%" and "parts" are mentioned herein below, they mean "% by weight" and "parts by weight" unless otherwise specified.

Example 1

In a Henschel mixer, 10 kg of a master batch composition of infrared absorbent formed of 100 parts of a polyester resin (made by Kao Corporation and sold under the trademark designation of "Toughton NE1110") and 3 parts of an infrared absorbent (octakis-(anilino)-octakis(phenylthio) vanadyl phthalocyanine) was thoroughly mixed. Then, the resultant mixture was melted and kneaded in a MS type pressure kneader (made by Moriyama K.K.) at1000° C. for 30 minutes. Subsequently, the blend was cooled and pulverized with a coarse pulverizer into particles, not more than 1 mm in diameter, to obtain a master batch (1) of infrared absorbent. In this master batch, the infrared absorbent was perfectly dissolved in the polyester resin.

In a Henschel mixer, 10 kg of a toner composition formed of 10.3 parts of the master batch (1) of infrared absorbent, 90 parts of the same polyester resin as mentioned above, 5 parts of phthalocyanine blue (made by Toyo Ink Mfg. Co., Ltd. and sold under the trademark designation of "Rionol Blue-ES"), and 1 part of an electric charge controlling agent (made by Orient Kagaku Kogyo K.K. and sold under the trademark designation of "Bontron E82") was thoroughly mixed. Then the toner composition was fed continuously to a biaxial extruding device and melt and kneaded therein.

The melt kneaded toner composition was cooled, then pulverized coarsely, and further pulverized finely with a jet mill. The fine powder consequently obtained was classified with a wind power classifier to obtain a blue powder having an average particle diameter of 8.7 μm.

In a Henschel mixer, 100 parts of this blue powder and 0.4% of hydrophobic silica (made by Nippon Aerosil K.K. and sold under the product code of "Silica R972") added thereto were uniformly mixed to obtain a toner (1).

The toner (1) obtained as described above was rated with respect to fixing property, fogging on an image, and voids in a fixed image in accordance with the methods described herein below. The results are shown in Table 1.

Example 2

A master batch (2) of infrared absorbent was obtained by treating 10 kg of a master batch composition of infrared absorbent formed of 100 parts of a styrene-acrylic resin (made by Sanyo Kasei K.K. and sold under the product code of "TB-1000") and 10 parts of an infrared absorbent (made by Nippon Kayaku Co., Ltd. and sold under the trademark designation of Kayasoub CY10") in the same manner as in Example 1. In this master batch, the infrared absorbent was perfectly dissolved in the styrene-acrylic resin.

A toner (2) was obtained by treating 10 kg of a toner composition formed of 11 parts of the master batch (2) of infrared absorbent, 70 parts of the styrene-acrylic resin, 20 parts of styrene-acrylic resin (made by Sanyo Kasei K.K. and sold under the product code of "STl-95"), 7 parts of a red pigment (made by Toyo Ink Mfg. Co., Ltd. and sold under the trademark designation of "Lionel Red CP-A"), and 1 part of an electric charge controlling agent (made by Orient Kagaku Kogyo K.K. and sold under the trademark designation of "Bontron E84") in the same manner as in Example 1. This toner has an average particle diameter of 9.5 μm.

The toner (2) obtained as described above was rated with respect to fixing property, fogging on an image, and voids in a fixed image in accordance with the methods described herein below. The results are shown in Table 1.

Example 3

A master batch (3) of infrared absorbent having an infrared absorbent dispersed in the form of particles, not more than 0.5 μm in diameter, was obtained by following the procedure of Example 2 while using 35 parts of bis (1,2-diphenylecene-1,2-dithiol) nickel in the place of 10 parts of the infrared absorbent (Kayasoub CY10) and effecting the treatment of melting and kneading in the same device as in Example 1.

Incidentally, the diameter of the dispersed particles of infrared absorbent was determined by dissolving a sample of the master batch of infrared absorbent in toluene and measuring the particle diameters of the infrared absorbent in the solution with the aid of an optical microscope.

A toner (3) was obtained by following the procedure of Example 2 while using 13.5 parts of the master batch (3) of infrared absorbent prepared as described above in the place of 11 parts of the master batch (2) of infrared absorbent. This toner was found to have an average particle diameter of 8.5 μm.

The toner (3) obtained as described above was rated with respect to fixing property, fogging on an image, and voids in a fixed image in accordance with the methods described herein below. The results are shown in Table 1.

Example 4

A master batch (4) of infrared absorbent was obtained by following the procedure of Example 1 while using 25 parts of octakis(anilino)octafluorovanadyl phthalocyanine in the place of 3 parts of the infrared absorbent, i.e. octakis (anilino)-octakis-(phenylthio) vanadyl phthalocyanine. In this master batch, the infrared absorbent was dissolved to fairly a large extent in the polyester resin and part of the infrared absorbent was found in an undissolved state. The particles of the dispersed infrared absorbent had diameters not exceeding 0.3 μm.

A toner (4) was obtained by following the procedure of Example 1 while using 2.5 parts of the master batch (4) of infrared absorbent manufactured as described above in the place of 10.3 parts of the master batch (1) of infrared absorbent. This toner was found to have an average particle diameter of 6.0 μm.

The toner (4) obtained as described above was rated with respect to fixing property, fogging on an image, and voids in a fixed image in accordance with the methods described herein below. The results are shown in Table 1.

Example 5

In 800 parts of water having dissolved therein 10 parts of polyvinyl alcohol (made by Kuraray Co., Ltd. and sold under the product code of "PVA205"), a polymerizing monomer composition formed by uniformly dissolving 85 parts of styrene, 15 parts of n-butyl acrylate, 5 parts of an infrared absorbent [octakis-(anilino)-octakis(phenylthio) vanadyl phthalocyanine], and 1 part of 2,2'-azobis-butyronitrile (made by Nippon Hydrazine Kogyo K.K. and sold under the product code of "ABNR") was stirred with a paddle vane and subjected meanwhile to suspension polymerization under an atmosphere of nitrogen at 75° C. for eight hours.

A master batch (5) of infrared absorbent was obtained by separating consequently formed infrared absorbent-containing resin beads from the polymerization solution, thoroughly washing the beads, and drying the washed beads with a hot air drier at 50° C. In this master batch, the infrared absorbent was perfectly dissolved in the resin matrix.

A toner (5) was obtained by following the procedure of Example 2 while using 4.4 parts of the master batch (5) of infrared absorbent manufactured as described above in the place of 11 parts of the master batch (2) of infrared absorbent. This toner was found to have an average particle diameter of 7.5 μm.

The toner (5) obtained as described above was rated with respect to fixing property, fogging on an image, and voids in a fixed image in accordance with the methods described herein below. The results are shown in Table 1.

Control 1

A toner for comparison (C1) was obtained by following the procedure for the production of the toner from the toner composition as described in Example 1 while omitting the preparation of the master batch and using 10 kg of a toner composition formed of 100 parts of a polyester resin (made by Kao Corporation and sold under the trademark designation of "Toughton NE1110"), 0.3 part of an infrared absorbent [octakis(anilino)-octakis(phenylthio) vanadyl phthalocyanine), 5 parts of phthalocyanine blue (made by Toyo Ink Mfg. Co., Ltd. and sold under the trademark designation of "Lionol Blue ES"), and 1 part of an electric charge controlling agent (made by Orient Kagaku Kogyo K.K. and sold under the trademark designation of "Bontron E82") instead. This toner was found to have an average particle diameter of 9.0 μm.

The toner for comparison (C1) obtained as described above was rated with respect to fixing property, fogging on an image, and voids in a fixed image in accordance with the methods described herein below. The results are shown in Table 1.

Control 2

A toner for comparison (C2) was obtained by following the procedure for the production of the toner from the toner composition as described in Example 1 while using 10 kg of a toner composition formed of 80 parts of styrene-acrylic resin (made by Sanyo Kasei K.K. and sold under the product code of "TB-1000"), 20 parts of styrene-acrylic resin (made by Sanyo Kasei K.K. and soldunder theproduct code of "ST-95"), 1 part of an infrared absorbent (made by Nippon Kayaku Co., Ltd. and sold under the trademark designation of "Kayasoub CY10"), 7 parts of a red pigment (made by Toyo Ink Mfg. Co., Ltd. and sold under the trademark designation of "Lionel Red CP-A"), and 1 part of an electric charge controlling agent (made by Orient Kagaku Kogyo K.K. and sold under the trademark designation of "Bontron E84") instead. This toner was found to have an average particle diameter of 9.3 μm.

The toner for comparison (C2) obtained as described above was rated with respect to fixing property, fogging on an image, and voids in a fixed image in accordance with the methods described herein below. The results are shown in Table 1.

Control 3

A toner for comparison (C3) was obtained by following the procedure of Control 2 while using 6.9 parts of bis(1,2-diphenylecene-1,2-dithiol) nickel in the place of 1 part of the infrared absorbent (Kayasoub CY10). This toner was found to have an average particle diameter of 9.1 μm.

The toner for comparison (C3) obtained as described above was rated with respect to fixing property, fogging on an image, and voids in a fixed image in accordance with the methods described herein below. The results are shown in Table 1.

Referential Example 1

A referential master batch of infrared absorbent (R1) was obtained by following the procedure of Example 2 while changing the amount of the infrared absorbent to 60 parts. In this master batch, the infrared absorbent was dissolved to fairly a large extent in the resin matrix and a large proportion of the infrared absorbent was found in an undissolved state. The particles of the infrared absorbent included in a large proportion crude particles measuring not less than 1 μm in diameter.

Then, a referential toner (R1) was obtained by following the procedure of Example 2 while using 2.7 parts of the referential master batch of infrared absorbent (R1) in the place of 11 parts of the master batch of infrared absorbent (2). This toner was found to have an average particle diameter of 9.4 μm.

The referential toner (R1) obtained as described above was rated with respect to fixing property, fogging on an image, and voids in a fixed image in accordance with the methods described herein below. The results are shown in Table 1.

Methods of rating State of infrared absorbent in master batch

The infrared absorbents in the master batches obtained in the varying experiments described above were visually examined to determine their states of aggregation. Since the infrared absorbents other than the infrared absorbent used in Example 3 were soluble in a solvent, the observation of the state of aggregate in the experiments other than Example 3 was carried out by hot-pressing a given master batch thereby preparing a film, 0.1 mm in thickness, and observing this film under an optical microscope.

Test for degree of fixation

A developing agent composed of 4 parts of a toner and 96 parts of a carrier coated with an acryl-modified silicon resin was set in a commercially available copying device (made by Toshiba Corporation and sold under the trademark designation of "Leodry 7610"). A loose image was formed on the layer of the developing agent and then flash fixed by the use of a xenon flash lamp.

The flash fixed image was subjected to a tape peeling test using a Scotch mending tape (made by 3M). The ratio of the image remaining after the tape separation was reported as the degree of fixation.

The ratio of residual image after the tape separation was determined by measuring the image density before and after the tape separation and performing calculation of the following formula using the results of the measurement.

Degree of fixation (%)=(Image density after the tape separation)/(image density before the tape separation)×100

The image density was measured with an instrument (made by A Division Kollmorgen Corp and sold under the trademark designation of "McBeth Reflection Densitometer, Model RD514").

Fogging on image

The toner fogging formed on the white image part of a sample was rated by visual observation of the sample by the use of a magnifying glass at 20 magnifications. The rating was made on the following three-point scale, wherein ○: Absence of toner fogging Δ: Presence of toner fogging on a level causing no problem X: Copious problematic presence of toner fogging Rating of voids in fixed image The wholly black part of a given fixed image was observed under a microscope (100 magnifications) to find and rate voids (white spots). The rating was made on the following four-point scale, wherein ○: Absence of discernible void Δ: Presence of a few discernible voids X: Presence of numerous discernible voids -: Not ratable because of absence of fixation

TABLE 1

| | Toner | Infrared absorbent* | Amount added (PHR) | Toner particle diameter (μm) | Degree of fixation (%) | Fogging | Voids |
|---|---|---|---|---|---|---|---|
| Example 1 | (1) | A | 0.3 | 8.7 | 93 | ○ | ○ |
| Example 2 | (2) | B | 1.0 | 9.5 | 90 | ○ | ○ |
| Example 3 | (3) | C | 3.1 | 8.8 | 89 | ○ | ○ |
| Example 4 | (4) | D | 0.5 | 6.0 | 91 | ○ | ○ |
| Example 5 | (5) | A | 0.2 | 7.5 | 94 | ○ | ○ |
| Control 1 | (C1) | A | 0.3 | 9.0 | 56 | Δ | Δ |
| Control 2 | (C2) | B | 1.0 | 9.3 | 62 | X | Δ |
| Control 3 | (C3) | C | 6.0 | 9.1 | 66 | X | X |
| | (R1) | B | 1.0 | 9.4 | 85 | Δ | X |

*A-Octakis(anilino)-octakis(phenylthio)vanadyl phthalocyanine, $\lambda_{max}$ 964 nm
B-Kayasoub CY 10, made by Nippon Kayaku Co., Ltd., $\lambda_{max}$ 799 nm
C-Bis(1,2-diphenylecene-1,2-dithiol)nickel, $\lambda_{max}$ 869 nm
D-Octakis(anilino)octafluorovanadyl phthalocyanine, $\lambda_{max}$ 890 nm Industrial Applicability This invention, owing to the use of a master batch which, as described above, contains an infrared absorbent at a concentration 3–50 times that of the infrared absorbent to be incorporated in the manufacture of a flash fixing toner, allows the toner, if produced in a continuous process, to contain the infrared absorbent at a fixed concentration and, at the same time, permits the infrared absorbent to be finely dispersed in the toner, and consequently enables the produced toner to acquire such physical properties as fixing property and electrically charging property in a stable state. The use of the master batch according to this invention precludes easy occurrence of voids in the produced image because the infrared absorbent is dissolved or finely dispersed in the toner composition. Further, the infrared absorbent contained in the toner composition in enabled to manifest the function thereof thoroughly, notwithstanding it is used in a very small amount relative to the amount of the toner composition.

What is claimed is:

1. A method for the production of a flash fixing toner containing at least a binding resin, a coloring agent, and an infrared absorbent, which method is characterized by the steps of blending a master batch containing said infrared absorbent at a concentration 3–50 times as thick as that intended to be incorporated ultimately in the toner, with other toner components, thereby forming a toner composition containing said infrared absorbent at a requested concentration, melting and kneading said toner composition, cooling the molten toner composition, and then pulverizing the solidified toner composition.

2. A method according to claim 1, wherein said infrared absorbent has an maximum absorption wavelength in the range of 750 nm–1100 nm.

3. A method according to claim 1 or claim 2, wherein said infrared absorbent is incorporated in said toner composition at a ratio in the range of 0.01 wt. %–5 wt. % based on the total amount of said toner composition.

* * * * *